US010013902B2

(12) United States Patent
Choi

(10) Patent No.: US 10,013,902 B2
(45) Date of Patent: Jul. 3, 2018

(54) DISPLAY DEVICE AND RELATED ELECTRONIC DEVICE

(71) Applicant: Samsung Display Co., LTD., Yongin-si, Gyeonggi-Do (KR)

(72) Inventor: Hak-Ki Choi, Suwon-si (KR)

(73) Assignee: Samsung Display Co., Ltd. (KR)

( * ) Notice: Subject to any disclaimer, the term of this patent is extended or adjusted under 35 U.S.C. 154(b) by 101 days.

(21) Appl. No.: 15/187,154

(22) Filed: Jun. 20, 2016

(65) Prior Publication Data

US 2017/0178588 A1 Jun. 22, 2017

(30) Foreign Application Priority Data

Dec. 17, 2015 (KR) ..... 10-2015-0181311

(51) Int. Cl.

| | |
|---|---|
| ***G09G 3/20*** | (2006.01) |
| ***G09G 3/36*** | (2006.01) |
| ***G09G 3/3208*** | (2016.01) |

(52) U.S. Cl.

CPC ..... *G09G 3/20* (2013.01); *G09G 3/3208* (2013.01); *G09G 3/3696* (2013.01); *G09G 2320/0247* (2013.01)

(58) Field of Classification Search

CPC ..... G09G 2320/0247; G09G 3/20

See application file for complete search history.

(56) References Cited

U.S. PATENT DOCUMENTS

| | | | | |
|---|---|---|---|---|
| 7,952,651 | B2 * | 5/2011 | Kimura | G02F 1/136213 349/38 |
| 8,199,267 | B2 * | 6/2012 | Kimura | G02F 1/136213 349/38 |
| 8,542,330 | B2 * | 9/2013 | Kimura | G02F 1/136213 349/38 |
| 9,075,546 | B2 * | 7/2015 | Jeong | G03G 15/5004 |
| 2002/0000963 | A1 * | 1/2002 | Yoshida | G09G 3/3611 345/87 |
| 2008/0284719 | A1 * | 11/2008 | Yoshida | G02F 1/136277 345/102 |

FOREIGN PATENT DOCUMENTS

| | | |
|---|---|---|
| KR | 10-1999-0015133 A | 3/1999 |
| KR | 10-2008-0064925 A | 7/2008 |
| KR | 10-2013-0051178 A | 5/2013 |
| KR | 10-2015-0078833 A | 7/2015 |

* cited by examiner

*Primary Examiner* — Gene W Lee
(74) *Attorney, Agent, or Firm* — Innovation Counsel LLP

(57) ABSTRACT

A display device may include a frequency detector, a control part, and a display panel. The frequency detector may receive an alternating current and may detect (and/or calculate) an alternating-current frequency associated with the alternating current. The control part may be electrically connected to the frequency detector and may generate a control signal using the alternating-current frequency. The display panel may be electrically connected to the control part and may display an image using the control signal.

18 Claims, 7 Drawing Sheets

DISPLAY DEVICE AND RELATED ELECTRONIC DEVICE

CROSS-REFERENCE TO RELATED APPLICATION(S)

This application claims priority under 35 USC § 119 to Korean Patent Application No. 10-2015-0181311, filed on Dec. 17, 2015 in the Korean Intellectual Property Office (KIPO); the contents of the Korean Patent Application are incorporated herein by reference.

BACKGROUND

1. Technical Field

The technical field relates to a display device, e.g., a transparent display device, and an electronic device having the display device.

2. Description of Related Art

A display device, such as a transparent display device, may utilize a light supplied from an external light source for displaying an image and may not include a backlight unit. Quality of an image displayed by the display device may be unsatisfactory if an operating frequency associated with the light source is not suitable for the display device.

SUMMARY

Some example embodiments are related to a display device, e.g., a transparent display device, capable of displaying high-quality image.

Some example embodiments are related to an electronic device capable of displaying high-quality image.

Some example embodiments may be related to a display device. The display device may include a frequency detector, a control part, and a display panel. The frequency detector may receive a first copy of an alternating current and may detect (and/or calculate) an alternating-current frequency associated with the alternating current. The control part may be electrically connected to the frequency detector and may generate a control signal using the alternating-current frequency. The display panel may be electrically connected to the control part and may display an image using the control signal.

The control part may determine (e.g., select) a frame frequency based on the alternating-current frequency and may generate the control signal using the frame frequency.

The control part may set the frame frequency equal to a multiple of the alternating-current frequency (i.e., a natural number times the alternating-current frequency).

The control part may set the frame frequency equal to two times the alternating-current frequency.

The control part may include a storage device. The storage device may store alternating-current frequency values, frame frequency values that respectively correspond to the alternating-current frequency values, and corresponding relations between the alternating-current frequency values and frame frequency values. The alternating-current frequency values may include the alternating-current frequency. The frame frequency values may include the frame frequency.

The control part may include a lookup table. The lookup table may store alternating-current frequency values and may store frame frequency values that respectively correspond to the alternating-current frequency values. The alternating-current frequency values may include the alternating-current frequency. The frame frequency values may include the frame frequency. The frame frequency may correspond to the alternating-current frequency according to the lookup table.

The display device may include a switching mode power supply circuit. The switching mode power supply circuit may be electrically connected to the frequency detector, may receive the first copy of the alternating current from the frequency detector, and may generate an output voltage associated with a direct current using the first copy of the alternating current.

The display panel may be electrically connected through the switching mode power supply circuit to the frequency detector.

The display device may include a lighting device. The lighting device may receive a second copy of the alternating current. The control part may set a frame frequency equal to an operating frequency of the lighting device using the alternating-current frequency and may generate the control signal using the frame frequency.

The operating frequency of the lighting device may be equal to a multiple of the alternating-current frequency. The control part may set a frame frequency equal to the multiple of the alternating-current frequency and may generate the control signal using the frame frequency.

Some example embodiments may be related to an electronic device. The electronic device may include a power supply device, a frequency detector, a control part, and a display panel. The power supply device may provide an alternating current. The frequency detector may be electrically connected to the power supply device, may receive a first copy of the alternating current, and may detect (and/or calculate) an alternating-current frequency associated with the alternating current. The control part may be electrically connected to the frequency detector and may generate a control signal using the alternating-current frequency. The display panel may be electrically connected to the control part and may display an image using the control signal.

The control part may determine a frame frequency based on the alternating-current frequency and may generate the control signal using the frame frequency.

The control part may set the frame frequency equal to a multiple of the alternating-current frequency.

The control part may set the frame frequency equal to two times the alternating-current frequency.

The control part may include a storage device. The storage device may store alternating-current frequency values, frame frequency values that respectively correspond to the alternating-current frequency values, and corresponding relations between the alternating-current frequency values and frame frequency values. The alternating-current frequency values include the alternating-current frequency. The frame frequency values include the frame frequency.

The control part comprises a lookup table. The lookup table stores alternating-current frequency values and stores frame frequency values that respectively correspond to the alternating-current frequency values. The alternating-current frequency values include the alternating-current frequency. The frame frequency values include the frame frequency. The frame frequency corresponds to the alternating-current frequency according to the lookup table.

The electronic device may include a switching mode power supply circuit. The switching mode power supply circuit may be electrically connected through the frequency detector to the power supply device, may receive the first copy of the alternating current from the frequency detector, and may generate an output voltage associated with a direct current using the first copy of the alternating current.

The display panel may be electrically connected through the switching mode power supply circuit to the frequency detector. The display panel may be electrically connected through the switching mode power supply circuit and the frequency detector to the power supply device.

The electronic device may include a lighting device. The lighting device may be electrically connected to the power supply device and may receive a second copy of the alternating current. The control part may set a frame frequency equal to an operating frequency of the lighting device using the alternating-current frequency and may generate the control signal using the frame frequency.

The operating frequency of the lighting device may be equal to a multiple of the alternating-current frequency. The control part may set a frame frequency equal to the multiple of the alternating-current frequency and may generate the control signal using the frame frequency.

According to example embodiments, a display device, e.g., a transparent display device, may include the following elements: a transparent display panel including a plurality of pixels; a power generator configured to receive an alternating current (AC) power, detect a frequency of the alternating current power, and convert the alternating current power to a direct current (DC) power for providing a high power voltage and a low power voltage to the pixels; a data driver configured to provide a data signal to the pixels; a scan driver configured to provide a scan signal to the pixels; and a timing controller configured to generate control signals that control the data driver and the scan driver based on the frequency of the alternating current power detected in the power generator.

The power generator may include a frequency detector configured to detect the frequency of the alternating current power, a switching mode power supply (SMPS) circuit configured to convert the alternating current power to the direct current power, and a DC-DC converter configured to generate the high power voltage and the low power voltage based on the direct current power.

The timing controller may select a frame frequency based on the frequency of the alternating current power.

The timing controller may generate a data control signal and a scan control signal based on the frame frequency.

The data driver may provide the data signal to the transparent display panel based on the data control signal.

The scan driver may provide the scan signal to the transparent display panel based on the scan control signal.

The timing controller may include a storage device that stores a frame frequency corresponding to the frequency of the alternating current power.

The storage device may include a lookup table.

The transparent display panel may be/include a transparent liquid crystal display panel.

The transparent display panel may be/include an organic light emitting display panel.

According to example embodiments, an electronic device may include a transparent display device and a processor that controls the transparent display device. The transparent display device may include the following elements: a transparent display panel including a plurality of pixels; a power generator configured to receive an alternating current (AC) power, detect a frequency of the alternating current power, and convert the alternating current power to a direct current (DC) power for providing a high power voltage and a low power voltage to the pixels; a data driver configured to provide a data signal to the pixels; a scan driver configured to provide a scan signal to the pixels; and a timing controller configured to generate control signals that control the data driver and the scan driver based on the frequency of the alternating current power detected in the power generator.

The power generator may include a frequency detector configured to detect the frequency of the alternating current power, a switching mode power supply (SMPS) circuit configured to convert the alternating current power to the direct current power, and a DC-DC converter configured to generate the high power voltage and the low power voltage based on the direct current power.

The timing controller may select a frame frequency based on the frequency of the alternating current power.

The timing controller may generate a data control signal and a scan control signal based on the frame frequency.

The data driver may provide the data signal to the transparent display panel based on the data control signal.

The scan driver may provide the scan signal to the transparent display panel based on the scan control signal.

The timing controller may include a storage device that stores a frame frequency corresponding to the frequency of the alternating current power.

The storage device may be implemented as a lookup table (LUT).

The transparent display panel may be implemented as a transparent liquid crystal display panel.

The transparent display panel may be implemented as an organic light emitting display panel.

According to embodiments, a display device and/or a related electronic device may prevent image defects (such as a flicker or a waterfall) by setting a frame frequency based on a frequency of an alternating current (AC) power provided to a lighting device (used for illuminating the display device) and the display device. Advantageously, the display device and/or the electronic device may display high-quality images.

BRIEF DESCRIPTION OF THE DRAWINGS

Illustrative, non-limiting example embodiments will be more clearly understood from the following detailed description taken in conjunction with the accompanying drawings.

DETAILED DESCRIPTION OF EMBODIMENTS

Figure 1:
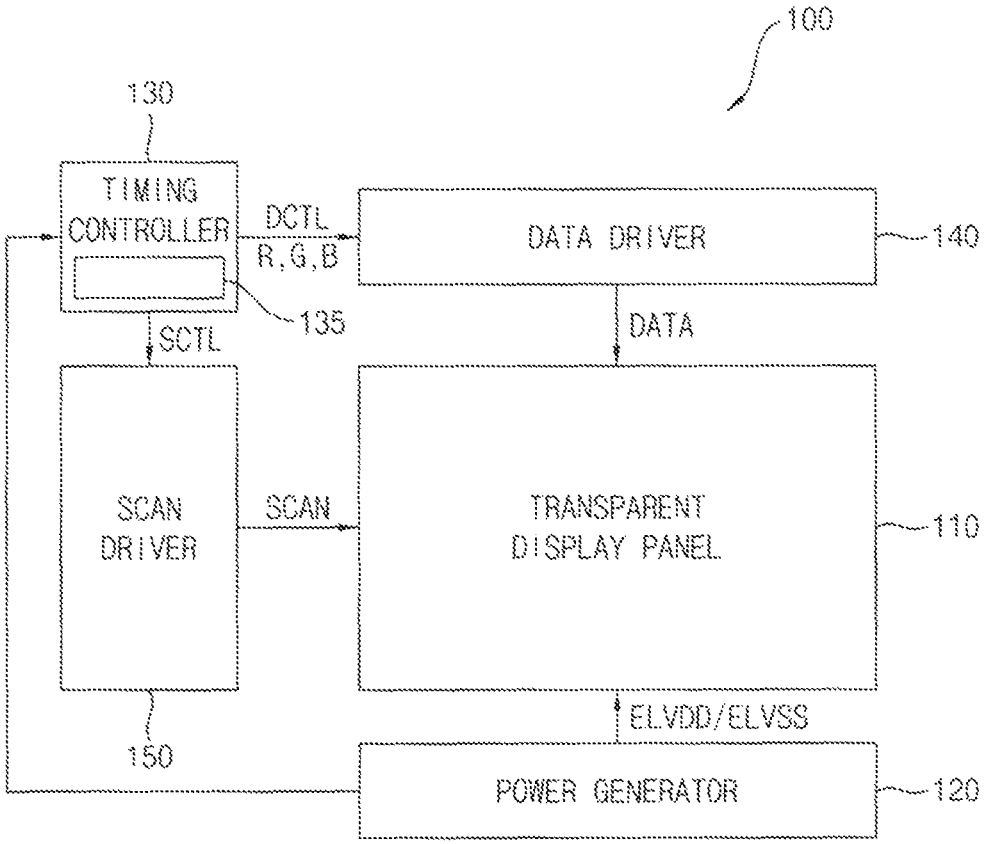
FIG. 1 is a block diagram illustrating a display device, e.g., a transparent display device, according to example embodiments.
Figure 2:
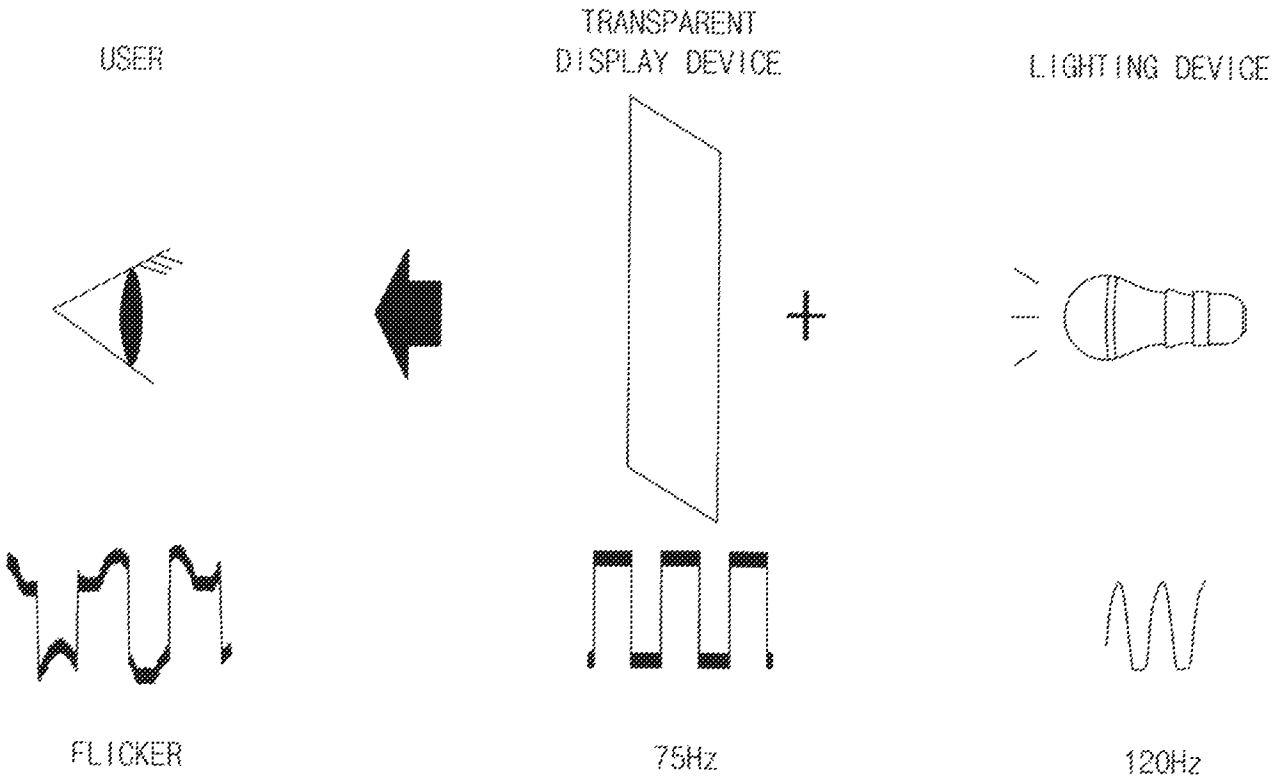
FIG. 2 is a diagram illustrating an operation of a display device, e.g., a transparent display device, according to example embodiments.

FIG. 1 is a block diagram illustrating a display device 100, e.g., a transparent display device 100, according to example embodiments, and FIG. 2 is a diagram illustrating an operation of the transparent display device 100 according to example embodiments.

Referring to FIG. 1, the transparent display device 100 may include a transparent display panel 110, a power generator 120, a data driver 140, a scan driver 150, and a timing controller 130. Some of the data driver 140, the scan driver 150, and the timing controller 130 may be collectively called a control part.

Referring to FIG. 2, the transparent display device 100 may use a light provided by an external device without including a backlight unit. For example, the light may be emitted from a lighting device. A user may recognize an image defect, such as a flicker or a waterfall, on the transparent display panel 110 if a frame frequency of the transparent display device 100 and a frequency of the light are different from each other and if the transparent display device 100 does not adjust the frame frequency. To minimize or prevent the image defect, the transparent display device 100 may detect a frequency of an alternating current (AC) power that drives the transparent display device 100 and the lighting device and may select/configure the frame frequency of the display device 100 based on the frequency of the alternating current power.

The transparent display device 100 of FIG. 1 may include the transparent display panel 110. The transparent display panel 110 may include a plurality of pixels. The transparent display device 100 may display visual information, such as images, text, contents, an application implementing screen, a web browser screen, and/or various graphic objects using the pixels. The transparent display panel 110 may be/include at least one of a transparent liquid crystal display (LCD) panel, a transparent organic light emitting display (OLED) panel, a transparent thin film electroluminescent (TFEL) panel, a projection type panel, etc.

In example embodiments, the transparent display device 100 may be/include a transparent liquid crystal display device. The transparent liquid crystal display device may include a pair of polarized panels, optical films, transparent thin film transistors, and transparent electrodes without including a backlight unit.

In example embodiments, the transparent display device 100 may be/include a transparent organic light emitting display device. The transparent organic light emitting display device may include an organic light emitting layer that emits lights and is positioned between transparent electrodes.

The power generator 120 may receive the alternating current power, may detect a frequency of the alternating current power, may generate a first power supply voltage ELVDD (e.g., a high voltage), may generate a second power supply voltage ELVSS (e.g., ground voltage and/or a low voltage lower than the high voltage), and provide a direct current (DC) power to the pixels.

The power generator 120 may include a frequency detector, a switching mode power supply (SMPS) circuit, and a DC-DC converter.

The frequency detector may detect the frequency of the alternating current power. The frequency detector may be electrically connected between an alternating current power supply and the switching mode power supply circuit, may receive the alternating current power from the alternating current power supply, and may provide the alternating current power to the switching mode power supply circuit. For example, the frequency detector may include a counter that counts pulsations of the alternating current power using a reference clock signal and outputs a counting value. The value of the frequency of the alternating current power (detected by the frequency detector) may be provided to the timing controller 130.

The switching mode power supply circuit may convert the alternating current power to the direct current power. The switching mode power supply circuit may include a first stage and a second stage. The switching mode power supply circuit may generate a second stage output voltage. Further, the switching mode power supply circuit may receive a control signal at the first stage and control a voltage level of the second stage output voltage based on the control signal.

The DC-DC converter may generate the high power voltage ELVDD, may generate the low power voltage ELVSS, and may provide the voltage ELVDD and/or the voltage ELVSS to the display panel 110 based on the second stage output voltage provided from the switching mode power supply circuit. The high power voltage ELVDD may have a logic high level and a logic low level in one frame. In some example embodiments, the high power voltage ELVDD may only have a logic high level or a logic low level in one frame. The low power voltage ELVSS may have a logic high level and a logic low level in one frame. In some example embodiments, the low power voltage ELVSS may only have a logic high level or a logic low level in one frame.

The timing controller 130 may select a frame frequency based on the frequency of the alternating current power provided from the frequency detector of the power generator 120. Generally, the alternating current power may be provided in 50 Hz or 60 Hz. The lighting device may operate in a multiple of the frequency of the alternating current power. For example, the lighting device may operate in 100 Hz when the alternating current power is provided in 50 Hz. The lighting device may operate in 120 Hz when the alternating current power is provided in 60 Hz. The timing controller 130 may select the frame frequency based on the detected frequency of the alternating current power. For example, the timing controller 130 may include a storage device 135 that stores suitable (values of) frame frequencies corresponding to possible (values of) frequencies of the alternating current power and may select a suitable frame frequency corresponding to the frequency of the alternating current power. Here, the frame frequency may be a multiple of the frequency of the alternating current power such that the frame frequency may be equal to the operating frequency of the lighting device, e.g., 100 Hz or 120 Hz. The timing controller 130 may convert an image data provided based on a vertical synchronization signal (Vsync), a horizontal synchronization signal (Hsync), a clock signal, and the frame frequency to a digital image data per frame and provide the digital image data to the data driver 140 per frame. Further, the timing controller 130 may generate a data control signal DCTL for controlling the data driver 140 based on the frame frequency and provide the data control signal DCTL to the data driver 140. The timing controller 130 may generate a scan control signal SCTL for controlling the scan driver 150 based on the vertical synchronization signal, the horizontal synchronization signal, the clock signal, and the frame frequency and provide the scan control signal SCTL to the scan driver 150.

The scan driver 150 may generate a scan signal SCAN for driving the pixels based on the scan control signal SCTL provided from the timing controller 130. The scan signal SCAN may be provide to the pixels through a plurality of scan lines formed in the transparent display panel 110 according to a frame period that corresponds to the frame frequency.

The data driver 140 may convert the digital image data provided from the timing controller 130 to an analog image data, that is, a data voltage DATA based on the data control signal DCTL. The data driver 140 may provide the data voltage DATA to the pixels through a plurality of data lines formed in the transparent display panel 110 in response to the scan signal SCAN.

According to embodiments, the transparent display device 100 may prevent image defects (such as a flicker or waterfall) potentially caused by a difference and/or incompatibility between the frequency of the lighting device and the frame frequency of the transparent display device 100. Advantageously, the transparent display device 100 may display high-quality images.

Figure 3:
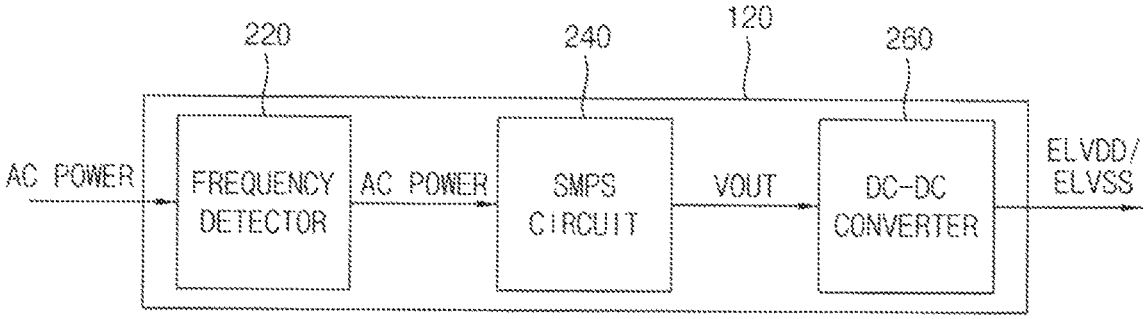
FIG. 3 is a diagram illustrating a power generator included in a display device, e.g., a transparent display device, according to example embodiments.
Figure 4:
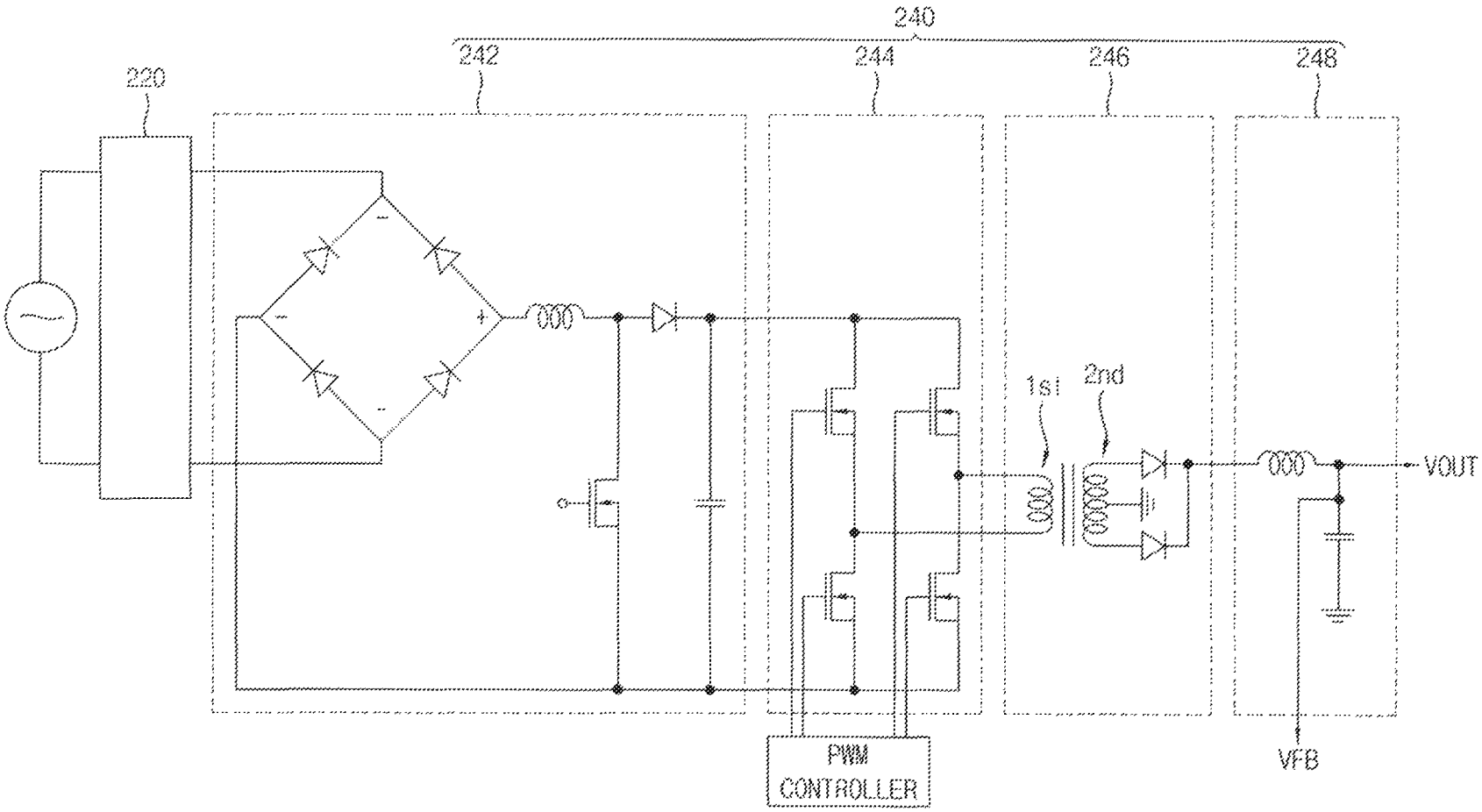
FIG. 4 is a diagram illustrating a frequency detector and a switching mode power supply circuit included in a power generator according to example embodiments.

FIG. 3 is a diagram illustrating the power generator 120 included in the transparent display device 100 illustrated in FIG. 1 according to example embodiments. FIG. 4 is a diagram illustrating an example of a frequency detector and a switching mode power supply circuit included in the power generator 120 according to example embodiments.

Referring to FIG. 3, the power generator 120 may include a frequency detector 220, a switching mode power supply circuit 240, and a DC-DC converter 260.

Referring to FIG. 3, the frequency detector 220 may be electrically connected between an alternating current power supply and the switching mode power supply circuit 240, may receive the alternating current power AC POWER from the alternating current power supply, may detect a frequency of the alternating current power AC POWER, and may provide the alternating current power AC POWER to the switching mode power supply circuit 240. For example, the frequency detector 220 may include a counter that counts a pulsation of the alternating current power AC POWER using a reference clock signal and outputs a counting value. The frequency of the alternating current power AC POWER detected in the frequency detector 220 may be provided to a timing controller, e.g., the timing controller 130 illustrated in FIG. 1.

Referring to FIG. 4, the switching mode power supply circuit 240 may include an input unit 242, a control unit 244, a transformation unit 246, and an output unit 248.

The input unit 242 may rectify and filter the alternating current voltage to generate a direct current voltage having a high voltage level. In some example embodiments, the input unit 242 may include a bridge rectifier and a power factor correction (PFC) circuit. The bridge rectifier may convert the bipolar alternating current voltage to a unipolar pulsating voltage. The bridge rectifier may have a structure in which a plurality of diodes are coupled in a bridge form and provide an output voltage having the same polarity (e.g., a positive polarity or a negative polarity) as an input voltage. The power factor correction circuit may improve power efficiency by compensating a power factor of the output voltage. The power factor correction circuit may reduce power consumption and prevent a temperature rise due to a heat generated by currents. As described above, the input unit 242 may rectify the alternating current voltage to generate the direct current voltage having the high voltage level. The switching mode power supply circuit 240 may further include a fuse and a line filter between the frequency detector 220 and the bridge rectifier although not described in FIG. 4. The fuse may operate as a safety device that opens and protects a circuit when a current exceeding a critical value flows during a specific period. The line filter may be a low pass electromagnetic interference (EMI) filter. The line filter may prevent signal interference by reducing a high frequency current that may flow into the alternating current voltage input stage in the switching mode power supply circuit 240.

The control unit 244 may receive the direct current voltage from the input unit 242. Further, the control unit 244 may receive a control signal from a PWM controller. The control unit 244 may generate a first output voltage from the direct current voltage based on the control signal. That is, a voltage level of the first output voltage may be determined based on a voltage level of the control signal.

The transformation unit 246 may receive the first output voltage 1st from the control unit 244 and generate a second output voltage 2nd by reducing the voltage level of the first output voltage. The second output voltage 2nd may be filtered by the output unit 248 to generate an output voltage VOUT. The output voltage VOUT may be provided to the DC-DC converter 260.

The DC-DC converter 260 may provide a high power voltage ELVDD and/or a low power voltage ELVSS to the display panel 110 (illustrated in FIG. 1) based on the output voltage VOUT provided from the switching mode power supply circuit 240. The high power voltage ELVDD may have a logic high level and a logic low level in one frame. In some example embodiments, the high power voltage ELVDD may have only a logic high level or a logic low level in one frame. The low power voltage ELVSS may have a logic high level and a logic low level in one frame. In some example embodiments, the low power voltage ELVSS may have only a logic high level or a logic low level in one frame. The DC-DC converter 260 may generate the high power voltage ELVDD or the low power voltage ELVSS by reducing or increasing the output voltage VOUT. In some example embodiments, the DC-DC converter may be implemented as a buck converter and may generate the high power voltage ELVDD or the low power voltage ELVSS by reducing the output voltage VOUT. In some example embodiments, the DC-DC converter may be implemented as a boost converter and may generate the high power voltage ELVDD or the low power voltage ELVSS by increasing the output voltage VOUT.

Figure 5:
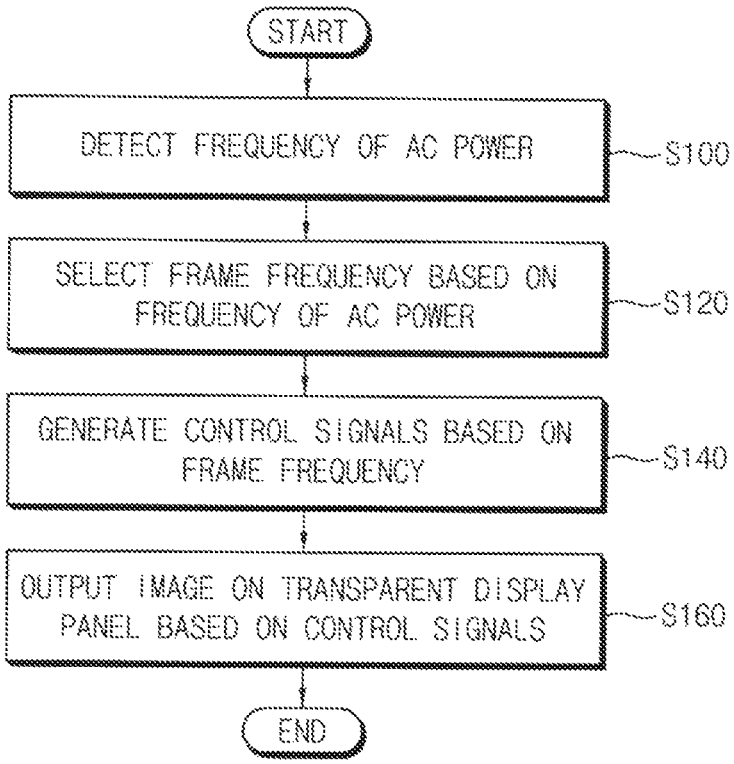
FIG. 5 is a flowchart illustrating an operation method of a display device, e.g., a transparent display device, according to example embodiments.

FIG. 5 is a flowchart illustrating an operation method of the display device 100, e.g., the transparent display device 100, illustrated in FIG. 1. The method may include steps S100, S120, S140, and S160.

Referring to FIG. 5, the transparent display device 100 may detect a frequency of an alternating current power in the step S100 and may select a frame frequency based on the frequency of the alternating current power in the step S120. Further, the transparent display device may generate control signals based on the frame frequency in the step S140 and may display an image based on the control signals in the step S160.

Specifically, the transparent display device 100 may detect the frequency of the alternating current power using a frequency detector in a power generator of the transparent device 100 in the step S100. For example, the frequency detector may detect the frequency of the alternating current power by counting pulsations of the alternating current power using a reference clock signal.

In the step S120, the transparent display device 100 may select the frame frequency based on the frequency of the alternating current power using a timing controller. The timing controller may include a storage device that stores the frame frequencies corresponding to the frequencies of the alternating current power. For example, the storage device may be/include a lookup table that stores the frame frequencies corresponding to the frequencies of the alternating current power. Here, the frame frequency may be a multiple frequency of the frequency of the alternating current power.

In the step S140, the transparent display device 100 may generate the control signals that control the data driver and the scan driver based on the frame frequency provided by the timing controller. The timing controller may generate a data control signal for controlling the data driver based on the frame frequency and provide the data control signal to the data driver. Further, the timing controller may generate a scan control signal for controlling the scan driver based on the frame frequency and provide the scan control signal to the scan driver.

In the step S160, the scan driver of the transparent display device 100 may generate a scan signal based on the scan control signal and provide the scan signal to pixels in a transparent display panel. The data driver of the transparent display device may convert image data provided from the timing controller to a data voltage and provide the data voltage to the pixels in the transparent display panel in response to the scan signal. Thus, an image may be displayed on the transparent panel.

Figure 6:
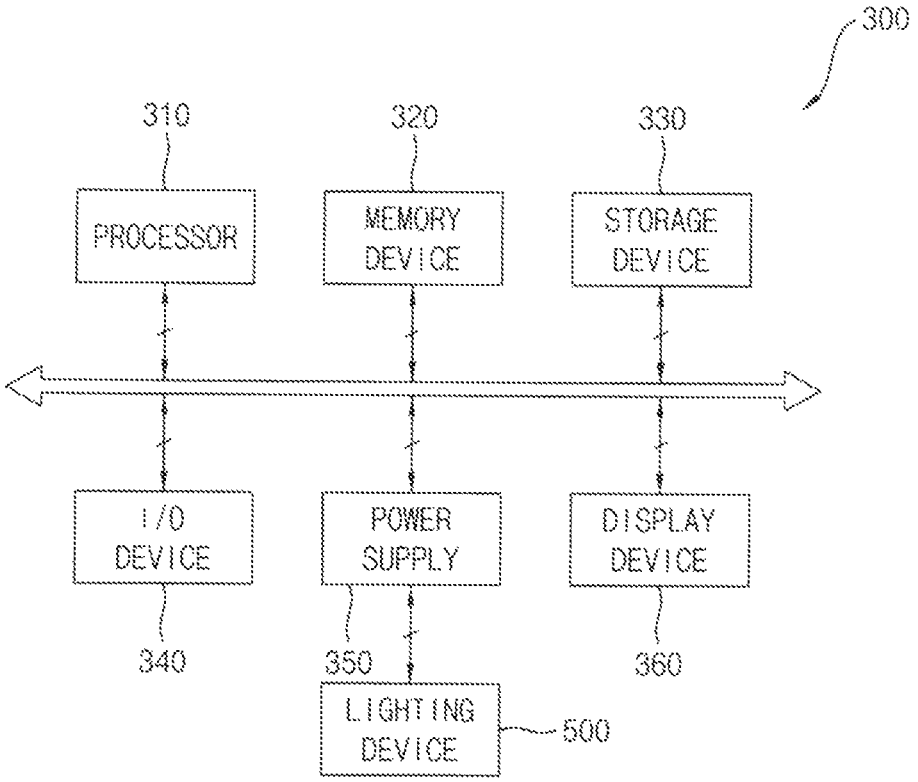
FIG. 6 is a block diagram illustrating an electronic device according to example embodiments.
Figure 7:
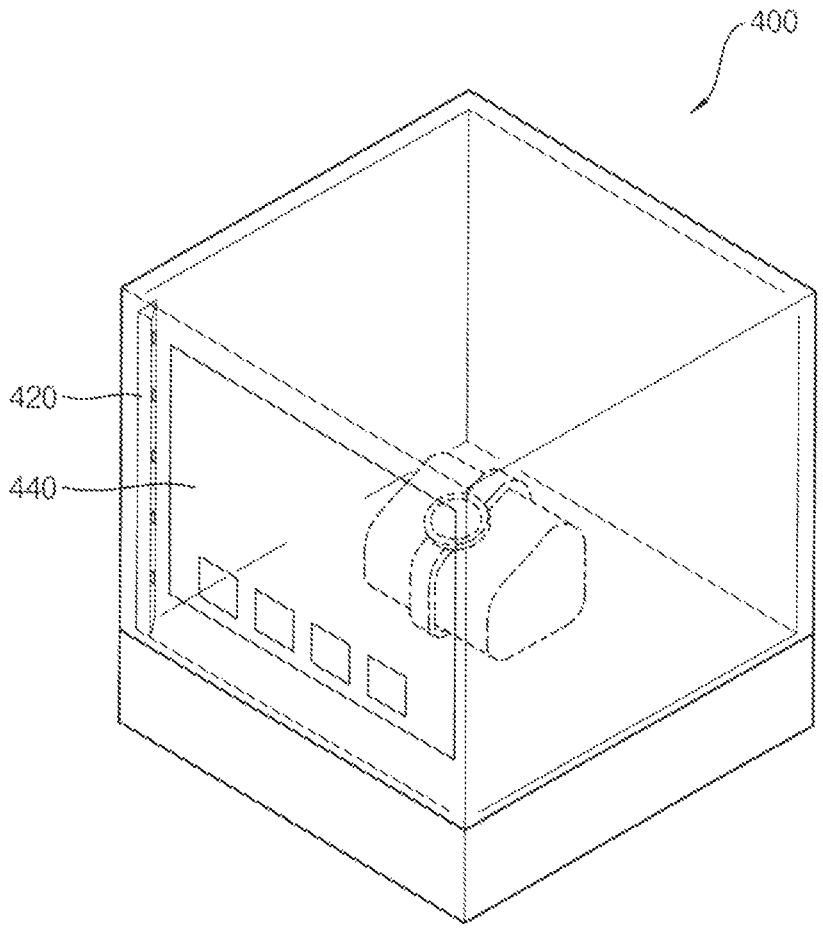
FIG. 7 is a diagram illustrating an electronic device according to example embodiments.

FIG. 6 is a block diagram illustrating an electronic device according to example embodiments. FIG. 7 is a diagram illustrating an example electronic device, a display case 400, according to example embodiments.

Referring to FIG. 6, an electronic device 300 may include a processor 310, a memory device 320, a storage device 330, an input/output (I/O) device 340, a power supply device 350, and a display device 360. Some features of the display device 360 may be analogous to or identical to some features of the display device 100, e.g., the transparent display device 100, discussed with reference to FIG. 1. In addition, the electronic device 300 may further include a plurality of ports for communicating a video card, a sound card, a memory card, a universal serial bus (USB) device, other electronic device, etc. Although it is illustrated in FIG. 7 that the electronic device 300 is implemented as a display case 400 for an exhibition, a kind of the electronic device 300 is not limited thereto.

The processor 310 may perform various computing functions. The processor 310 may be a microprocessor, a central processing unit (CPU), etc. The processor 310 may be coupled to other components via an address bus, a control bus, a data bus, etc. Further, the processor 310 may be coupled to an extended bus such as surrounded component interconnect (PCI) bus. The memory device 320 may store data for operations of the electronic device 300. For example, the memory device 320 may include at least one non-volatile memory device such as an erasable programmable read-only memory (EPROM) device, an electrically erasable programmable read-only memory (EEPROM) device, a flash memory device, a phase change random access memory (PRAM) device, a resistance random access memory (RRAM) device, a nano floating gate memory (NFGM) device, a polymer random access memory (PoRAM) device, a magnetic random access memory (MRAIVI) device, a ferroelectric random access memory (FRAM) device, etc., and/or at least one volatile memory device such as a dynamic random access memory (DRAM) device, a static random access memory (SRAM) device, a mobile DRAM device, etc. The storage device 330 may be a solid stage drive (SSD) device, a hard disk drive (HDD) device, a CD-ROM device, etc.

The I/O device 340 may be an input device such as a keyboard, a keypad, a touchpad, a touch-screen, a mouse, etc., and an output device such as a printer, a speaker, etc. In some example embodiments, the display device 360 may be included in the I/O device 340. The power supply device 350 may provide an alternating-current power for operations of the electronic device 300 and a related light source. The display device 360 may communicate with other components via the buses or other communication links. The display device 360 may be a transparent display device that uses light provided from an external light source instead of an internal light source. The display device 360 may include a transparent display panel, a power generator, a data driver, a scan driver, and a timing controller. In example embodiments, the display device 360 may be/include a transparent liquid crystal display device. In example embodiments, the display device 360 may be/include a transparent organic light emitting display device. The power generator may receive an alternating current power, detect a frequency of the alternating current power, and generate a high power voltage and a low power voltage provided to the pixels by converting the alternating current power to a direct current power. The power generator may detect the frequency of the alternating current power and provide the frequency of the alternating current power to the timing controller. The timing controller may select a frame frequency based on the frequency of the alternating current power and generate a data control signal that controls the data driver and a scan control signal that controls the scan driver based on the frame frequency. The data driver may generate a data signal based on the data control signal and provide the data signal to the transparent display panel in response to a scan signal. The scan driver may generate the scan signal based on the scan control signal and provide the scan signal to the transparent display panel. Thus, an image may be displayed on the transparent display panel. According to embodiments, the display device 360 may prevent image defects (such as a flicker or a waterfall) potentially caused by a difference and/or incompatibility between a frequency of the external lighting device 500 and the frame frequency of the display device 360 by detecting the frequency of the alternating current power provided to the external lighting device 500 and the display device 360 and by setting the frame frequency of the display device 360 based on the detected frequency of the alternating current power.

Referring to FIG. 7, the display case 400 for an exhibition may include a lighting device 420 and a transparent display device 440. The lighting device 420 may provide light to an exhibition product and may provide light to the transparent display device 440 as a light source. The lighting device 420 may be/include at least one of a fluorescent lamp, an incandescent lamp, a light emitting diode, etc. The lighting device 420 may be operated in a multiple of an alternating current power. The transparent display device 440 may use light provided from the lighting device 420 for displaying an image. The transparent display device 440 may detect the frequency of the alternating current power that drives the transparent display device 440 and select a frame frequency of the transparent display device 440 based on the frequency of the alternating current power. Here, the frame frequency may be a multiple of the alternating current power. Thus, the display case 400 of FIG. 7 that includes the lighting device 420 and the transparent display device 440 may prevent image defects (such as a flicker or waterfall) potentially caused by a difference and/or incompatibility between the frequency of the lighting device 420 and the frequency of the transparent display device 440.

Embodiments may be applied to display device, e.g., a transparent display device, and an electronic device having the display device. For example, embodiments may be applied to at least one of a computer monitor, a laptop, a digital camera, a cellular phone, a smart phone, a smart pad, a television, a personal digital assistant (PDA), a portable multimedia player (PMP), a MP3 player, a navigation system, a game console, a video phone, etc.

The foregoing is illustrative of example embodiments and is not to be construed as limiting. Although a few example embodiments have been described, those skilled in the art will readily appreciate that many modifications are possible in the example embodiments. All such modifications are included within the scope defined in the claims.

What is claimed is:

1. A display device comprising:

a frequency detector configured to receive a first instance of an alternating current and configured to detect an alternating-current frequency associated with the alternating current;

a switching mode power supply circuit electrically connected to the frequency detector, configured to receive the first instance of the alternating current from the frequency detector, and configured to generate an output voltage associated with a direct current using the first instance of the alternating current;

a control part electrically connected to the frequency detector and configured to generate a control signal using the alternating-current frequency; and a display panel electrically connected to the control part and configured to display an image using the control signal.

2. The display device of claim 1, wherein the control part is configured to determine a frame frequency based on the alternating-current frequency and is configured to generate the control signal using the frame frequency.

3. The display device of claim 2, wherein the control part is configured to set the frame frequency equal to a multiple of the alternating-current frequency.

4. The display device of claim 2, wherein the control part is configured to set the frame frequency equal to two times the alternating-current frequency.

5. The display device of claim 1, wherein the control part comprises a storage device, wherein the storage device stores alternating-current frequency values, frame frequency values that respectively correspond to the alternating-current frequency values, and corresponding relations between the alternating-current frequency values and frame frequency values, wherein the alternating-current frequency values include the alternating-current frequency, and wherein the frame frequency values include the frame frequency.

6. The display device of claim 1, wherein the control part comprises a lookup table, wherein the lookup table stores alternating-current frequency values and stores frame frequency values that respectively correspond to the alternating-current frequency values, wherein the alternating-current frequency values include the alternating-current frequency, wherein the frame frequency values include the frame frequency, and wherein the frame frequency corresponds to the alternating-current frequency according to the lookup table.

7. The display device of claim 1, wherein the display panel is electrically connected through the switching mode power supply circuit to the frequency detector.

8. The display device of claim 1 comprising: a lighting device configured to receive a second instance of the alternating current, wherein the control part is configured to set a frame frequency equal to an operating frequency of the lighting device using the alternating-current frequency and is configured to generate the control signal using the frame frequency.

9. The display device of claim 1 comprising: a lighting device configured to receive a second instance of the alternating current, wherein an operating frequency of the lighting device is equal to a multiple of the alternating-current frequency, and wherein the control part is configured to set a frame frequency equal to the multiple of the alternating-current frequency and is configured to generate the control signal using the frame frequency.

10. An electronic device comprising:

a power supply device configured to provide an alternating current;

a frequency detector electrically connected to the power supply device, configured to receive a first instance of the alternating current, and configured to detect an alternating-current frequency associated with the alternating current;

a switching mode power supply circuit electrically connected through the frequency detector to the power supply device, configured to receive the first instance of the alternating current from the frequency detector, and configured to generate an output voltage associated with a direct current using the first instance of the alternating current;

a control part electrically connected to the frequency detector and configured to generate a control signal using the alternating-current frequency; and a display panel electrically connected to the control part and configured to display an image using the control signal.

11. The electronic device of claim 10, wherein the control part is configured to determine a frame frequency based on the alternating-current frequency and is configured to generate the control signal using the frame frequency.

12. The electronic device of claim 11, wherein the control part is configured to set the frame frequency equal to a multiple of the alternating-current frequency.

13. The electronic device of claim 11, wherein the control part is configured to set the frame frequency equal to two times the alternating-current frequency.

14. The electronic device of claim 10, wherein the control part comprises a storage device, wherein the storage device stores alternating-current frequency values, frame frequency values that respectively correspond to the alternating-current frequency values, and corresponding relations between the alternating-current frequency values and frame frequency values, wherein the alternating-current frequency values include the alternating-current frequency, and wherein the frame frequency values include the frame frequency.

15. The electronic device of claim 10, wherein the control part comprises a lookup table, wherein the lookup table stores alternating-current frequency values and stores frame frequency values that respectively correspond to the alternating-current frequency values, wherein the alternating-current frequency values include the alternating-current frequency, wherein the frame frequency values include the frame frequency, and wherein the frame frequency corresponds to the alternating-current frequency according to the lookup table.

16. The electronic device of claim 10, wherein the display panel is electrically connected through the switching mode power supply circuit to the frequency detector and is electrically connected through the switching mode power supply circuit and the frequency detector to the power supply device.

17. The electronic device of claim 10 comprising: a lighting device electrically connected to the power supply device and configured to receive a second instance of the alternating current, wherein the control part is configured to set a frame frequency equal to an operating frequency of the lighting device using the alternating-current frequency and is configured to generate the control signal using the frame frequency.

18. The electronic device of claim 10 comprising: a lighting device electrically connected to the power supply device and configured to receive a second instance of the alternating current, wherein an operating frequency of the lighting device is equal to a multiple of the alternating-current frequency, and wherein the control part is configured to set a frame frequency equal to the multiple of the alternating-current frequency and is configured to generate the control signal using the frame frequency.

* * * * *